US008357224B2

(12) United States Patent
Zhou

(10) Patent No.: US 8,357,224 B2
(45) Date of Patent: Jan. 22, 2013

(54) METHOD OF IRON SMELTING IN BLAST FURNACE WITH HIGH TEMPERATURE COAL GAS

(76) Inventor: Jiule Zhou, Liaoning (CN)

( * ) Notice: Subject to any disclaimer, the term of this patent is extended or adjusted under 35 U.S.C. 154(b) by 85 days.

(21) Appl. No.: 12/988,515

(22) PCT Filed: Oct. 16, 2008

(86) PCT No.: PCT/CN2008/072714

§ 371 (c)(1),
(2), (4) Date: Oct. 19, 2010

(87) PCT Pub. No.: WO2009/129677

PCT Pub. Date: Oct. 29, 2009

(65) Prior Publication Data

US 2011/0036203 A1 Feb. 17, 2011

(30) Foreign Application Priority Data

Apr. 23, 2008 (CN) ..... 2008 1 0011158

(51) Int. Cl.
*C21B 5/06* (2006.01)
*C21B 5/00* (2006.01)

(52) U.S. Cl. ..... 75/463; 75/472

(58) Field of Classification Search ..... 75/463, 75/472

See application file for complete search history.

(56) References Cited

U.S. PATENT DOCUMENTS 2,837,419 A * 6/1958 Sellers et al. ..... 75/463
4,518,428 A * 5/1985 Ellenbaum et al. ..... 75/319
4,985,075 A * 1/1991 Ohno et al. ..... 75/460

OTHER PUBLICATIONS

Luo, Fusheng et al. CN 2247665, machine translation. Published Feb. 19, 1997.*

"Si prefixes" from "The NIST Reference on Constants, Units, and Uncertainty". Dowloaded from http://physics.nist.gov/cuu/Units/prefixes.html on Jun. 6, 2012.*

* cited by examiner

*Primary Examiner* — George Wyszomierski
*Assistant Examiner* — Tima M McGuthry Banks
(74) *Attorney, Agent, or Firm* — Che-Yang Chen; Law Office of Michael Chen

(57) ABSTRACT

A method of iron smelting in blast furnace with high temperature coal gas comprises the following steps: (1) charging raw materials consisting of pellets, basic sintered ore, coke and limestone into a blast furnace from top of the furnace, in which the amount of the coke is 125-210 kg per ton of molten iron, raw materials containing iron is composed of 90% pellets and 10% basic sintered ore, and ore grade is above 62%; (2) preheating coal gas to 1250-1450° C. with an horizontal high temperature blast heater, blowing the preheated coal gas having a thermal value of 11.7-12.5 mj/m3 into the blast furnace from top of the furnace at an amount of 1000 m3 per ton of molten iron and a pressure of 0.1-0.6 MPa; blowing air preheated to higher than 1250-1450° C. at an amount of 300-400 n m3 per ton of molten iron. The coal gas used in the method acts as a reducer and fuel, as a result the coke consumption would be reduced.

1 Claim, No Drawings

METHOD OF IRON SMELTING IN BLAST FURNACE WITH HIGH TEMPERATURE COAL GAS

This application is a national stage application of PCT/CN2008/072714, filed Oct. 16,2008.

BACKGROUND OF THE INVENTION

The present invention relates to Ferrous Metallurgy field, and further relates to iron smelting field. This invention is to blow pre-heated high-temperature coal gas into blast furnace used in traditional iron smelting process, so that to replace most of high temperature air blowing iron smelting processes.

Current iron smelting in blast furnace is to add alkaline sinter, pellets (iron oxide ores) coke, limestone, coal powder, air (preheated to 900-1250° C.) or oxygen-enriched air into blast furnace to smelt iron. Using the above said technology, the most advanced iron smelting process in China will discharge above 1500 kg carbon dioxide while smelting each 468 kg iron.

BRIEF SUMMARY OF THE INVENTION

This process of iron smelting in blast furnace is invented to further save energy, reduce carbon dioxide emission and improve the output of each effective volume unit of blast furnace.

The technical program used in this invention includes:

The method of iron smelting in blast furnace includes the following processes:

1. Charging raw materials consisting of pellets, basic sintered ore, coke and limestone into a blast furnace from top of the furnace, in which the amount of the coke is 125-210 kg per ton of molten iron, raw materials containing iron is composed of 90% pellets and 10% basic sintered ore, and ore grade is above 62%.

2. Preheating coal gas to 1250-1450° C. with an horizontal high temperature blast heater, blowing the preheated coal gas having a thermal value of 11.7-12.5mj/ $m^3$ (the unit "mj/ $m^3$"means "Megajoule Per Cubic Meter", and 1 Megajoule is equal to 1 Joule times 1.000.000) into the blast furnace from top of the furnace at an amount of 1000 $m^3$ per ton of molten iron and a pressure of 0.1-0.6mpa (the unit "mpa" means "Meqapascal", and 1 Megapascal is equal to 1 Pascal times 1,000,000): blowing air preheated to higher than 1250-1450° C. at an amount of 300-400n $m^3$ (the unit "$nm^3$" means "Normal Cubic Meter", and it is a unit for volume of gas in 1 cubic meter measured at 0° C. and 1 bar of atmospheric pressure) per ton of molten iron.

The coal gas used in the method acts as a reducer and fuel; as a result the coke consumption would be reduced.

The crude molten iron smelted from the above said process is not less than 1500° C.; silicon content is less than 0.2%; carbon content is 2.5-4.2%; The utilization factor of the blast furnace reaches 6-8 t/d $m^3$, one time higher than normal process, so it is possible to control the energy consumption of iron smelting at less than 325 kgce/t molten iron through this process.

The energy consumption of this invention is 143 kg/t less than the most advanced technology currently used in China, save energy 30.56% more than the most advance technology in use, and reduce carbon dioxide emission more than 40%. The slag produced by this invention is 1/3-1/2 less than that produced by the most advanced traditional process, and the coke ratio is 50% lower than the most advanced technology current used in China.

DETAILED DESCRIPTION OF THE INVENTION

Embodiment 1

A method of iron smelting in blast furnace with high temperature coal gas:

Charging raw materials consisting of pellets, basic sintered ore, coke and limestone into a blast furnace from top of the furnace, in which the amount of the coke is 150 kg per ton of molten iron, while the raw materials contain 90% of pellets. And then blowing the preheated coal gas of 1300-1400° C. into the blast furnace from top of the furnace at an amount of 1000 $m^3$ per ton of molten iron and a pressure of 0.3-0.5 mpa. At the same time, the preheated air of 300 n $m^3$/t-400 n $m^3$/t with the temperature of 1300-1400° C. is supplied to the blast furnace. The molten iron produced with this process is 1520° C. containing 0.18% of silicon and 3.0% of carbon; the utilization factor of the blast furnace is 7 t/d $m^3$ and the energy consumption is 320 kgce/t molten iron.

What is claimed is:

1. A method of iron smelting in a blast furnace with high temperature coal gas comprising the following steps:

1) charging raw materials consisting of pellets, basic sintered ore, coke, and limestone into a top of a blast furnace, in which the amount of coke is 125-210kg per ton of molten iron; and 2) producing molten iron by preheating coal gas to 1250-1450° C. with a horizontal high temperature blast heater and blowing the preheated coal gas having a thermal value of 11.7-12.5 MJ/$m^3$ into the blast furnace from the top of the furnace at an amount of 1000 $m^3$ per ton of molten iron and a pressure of 0.1-0.6 MPa; and at the same time supplying air preheated to higher than 1250-1450° C. to the blast furnace at an amount of 300-400 normal cubic meters per ton of molten iron.

* * * * *